US010565886B2

(12) United States Patent
Chikkegowda et al.

(10) Patent No.: US 10,565,886 B2
(45) Date of Patent: Feb. 18, 2020

(54) SYSTEMS AND METHODS FOR PREDICTING LOSS OF SEPARATION EVENTS

(71) Applicant: HONEYWELL INTERNATIONAL INC., Morris Plains, NJ (US)

(72) Inventors: Kantha Chikkegowda, Karnataka (IN); Balasubramanyam Ravindranath, Karnataka (IN); Shrinath Joshi, Karnataka (IN); Thomas Judd, Woodinville, WA (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 7 days.

(21) Appl. No.: 15/987,447

(22) Filed: May 23, 2018

(65) Prior Publication Data

US 2019/0362636 A1 Nov. 28, 2019

(51) Int. Cl.
*G08G 5/00* (2006.01)
*G08G 5/04* (2006.01)

(52) U.S. Cl.
CPC ..... *G08G 5/0039* (2013.01); *G08G 5/0013* (2013.01); *G08G 5/0021* (2013.01); *G08G 5/0078* (2013.01); *G08G 5/04* (2013.01)

(58) Field of Classification Search
CPC .. G08G 5/0039; G08G 5/0013; G08G 5/0021; G08G 5/0078; G08G 5/04
USPC ..... 701/120
See application file for complete search history.

(56) References Cited

U.S. PATENT DOCUMENTS 7,580,776 B1 8/2009 McCusker et al.
9,243,930 B2 1/2016 Bushnell
9,536,435 B1 1/2017 Shay
(Continued)

FOREIGN PATENT DOCUMENTS

EP 2365287 A2 9/2011
EP 2849168 A1 3/2015
(Continued)

OTHER PUBLICATIONS

Performance Based Communications and Surveillance (PBCS); Operational Data Link Seminar ICAO Asia and Pacific Office Bangkok, Thailand May 2-4, 2016.

*Primary Examiner* — Gertrude Arthur Jeanglaude
(74) *Attorney, Agent, or Firm* — Lorenz & Kopf, LLP

(57) ABSTRACT

Systems and methods directed to evaluating potential loss of separation are provided. The method continuously receives a host status data, as well as traffic flight information for neighbor traffic. Responsive to a controller pilot data link communication (CPDLC) message with a flight profile change, the method continues by processing the host aircraft status data and the traffic flight information, to (i) construct a modified host flight path based on incorporating the host profile change without delay, and (ii) construct a neighbor aircraft trajectory for a neighbor aircraft. The method processes the modified host flight path and the neighbor aircraft trajectory with loss of separation (LOS) rules, to identify a potential loss of separation (LOS) event. Responsive to identifying the potential LOS event, the method continues by annunciating information describing the potential LOS and its location.

20 Claims, 7 Drawing Sheets

(56) References Cited

U.S. PATENT DOCUMENTS

| | | | | |
|---|---|---|---|---|
| 2003/0093187 | A1* | 5/2003 | Walker | B64C 13/20 701/1 |
| 2008/0161982 | A1 | 7/2008 | Coulmeau et al. | |
| 2010/0152932 | A1 | 6/2010 | Das | |
| 2010/0332054 | A1 | 12/2010 | Brandao et al. | |
| 2011/0288773 | A1 | 11/2011 | Hoy | |
| 2013/0338909 | A1 | 12/2013 | de Blanes et al. | |
| 2015/0081138 | A1 | 3/2015 | Lacko et al. | |
| 2016/0125744 | A1 | 5/2016 | Shamasundar et al. | |
| 2016/0318446 | A1 | 11/2016 | Van Steenkist et al. | |

FOREIGN PATENT DOCUMENTS

| | | | |
|---|---|---|---|
| WO | 2008130948 | A1 | 10/2008 |
| WO | 2017013387 | A1 | 1/2017 |

* cited by examiner

TABLE 1

| Surrounding A/C | POC / POD | Vertical Distance | Lateral Distance | Angle |
|---|---|---|---|---|
| Aircraft 1 | None | Not Applicable | (314) 1 NM | Not Applicable |
| Aircraft 2 | None | (320) 100 ft. | Not Applicable | Not Applicable |

FIG. 6

TABLE 2

| Surrounding A/C | POC / POD | Vertical Distance | Lateral Distance | Angle |
|---|---|---|---|---|
| BA **150** | POC | 500 ft. | 1 NM | 10 |
| AA **205** | POC | 100 ft. | 0.5 NM | **30** |
| SA 1344 | POD | 50 ft. | 10 NM | **20** |
| AA 3210 | POC | 500 ft. | 5 NM | 10 |

FIG. 7

SYSTEMS AND METHODS FOR PREDICTING LOSS OF SEPARATION EVENTS

TECHNICAL FIELD

The technical field generally relates to aircraft guidance systems, and more particularly relates to systems and related operating methods for predicting loss of separation events.

BACKGROUND

Specified minima for lateral and vertical separation of airborne aircraft are often referred to as loss of separation (LOS) rules. These LOS rules are usually published by regulating authorities such as the Federal Aviation Association (FAA), and they may vary in accordance with controlled airspaces, phase of flight, and other factors. A loss of separation (LOS) event occurs whenever a specified separation minimum between airborne aircraft in controlled airspace is breached. The loss of separation event may be due to a variety of reasons, and they may be ATC induced situations or pilot induced situations.

As may be appreciated, a LOS event is undesirable. Responding to a LOS event is a very cognitively demanding and time sensitive endeavor. One challenging aspect is that many traffic avoidance maneuvers are restricted to only the vertical plane. Another challenging aspect is that many traffic data systems work independently of the aircraft navigation or flight management systems. Therefore, LOS evaluation systems that monitor the traffic data systems may be unable to address proposed flight profile changes for the host aircraft.

Accordingly, improved LOS evaluation systems that process neighbor traffic data with CPDLC conditional clearances and CPDLC requests are desired. The following disclosure provides these technological enhancements, in addition to addressing related issues.

BRIEF SUMMARY

This summary is provided to describe select concepts in a simplified form that are further described in the Detailed Description. This summary is not intended to identify key or essential features of the claimed subject matter, nor is it intended to be used as an aid in determining the scope of the claimed subject matter.

Provided is a method for evaluating loss of separation. The method includes: continuously receiving, from a source of host aircraft status data, a host speed, host position and location, and a host flight path angle; continuously receiving, from a traffic data system, traffic flight information for a plurality of neighbor traffic; receiving, from a controller pilot data link communication (CPDLC) source, a CPDLC message including a host flight profile change; and, responsive to receiving the CPDLC message, processing, at a control module, the CPDLC message with loss of separation rules, the host aircraft status data, and the traffic flight information, to (a) construct a modified host flight path based on incorporating the host profile change without delay, (b) identify a potential loss of separation (LOS) event between the modified host flight path and a neighbor aircraft trajectory, and (c) responsive to identifying the potential LOS event, generating annunciation commands for an annunciation system; and annunciating, by the annunciation system, the potential LOS and its location, responsive to the annunciation commands.

A system for evaluation loss of separation is provided. The system includes a source of host aircraft status data providing a host speed, host position and location, and a host flight path angle; a traffic data system providing traffic flight information for a plurality of neighbor traffic; a controller pilot data link communication (CPDLC) source providing a CPDLC message including a host flight profile change; a traffic management control module configured to: receive the host aircraft status data, the traffic flight information, and the CPDLC message; reference loss of separation rules; and construct a modified host flight path based on incorporating the host profile change without delay; identify a potential loss of separation (LOS) event between the modified host flight path and a neighbor aircraft trajectory, and (c) responsive to identifying the potential LOS event, generate annunciation commands.

Also provided is a method. The method includes, at a control module, continuously receiving, from a source of host aircraft status data, a host speed, host position and location, and a host flight path angle; continuously receiving, from a traffic data system, traffic flight information for a plurality of neighbor traffic; receiving, from a controller pilot data link communication (CPDLC) source, a CPDLC message including a host flight profile change; and, responsive to receiving the CPDLC message, (a) processing the host aircraft status data and the traffic flight information, to (i) construct a modified host flight path based on incorporating the host profile change without delay, and (ii) construct a neighbor aircraft trajectory for a neighbor aircraft; and (b) processing the modified host flight path and the neighbor aircraft trajectory with loss of separation (LOS) rules, to identify a potential loss of separation (LOS) event; and responsive to identifying the potential LOS event, annunciating, by an annunciation system, the potential LOS and its location.

Furthermore, other desirable features and characteristics of the system and method will become apparent from the subsequent detailed description and the appended claims, taken in conjunction with the accompanying drawings and the preceding background.

BRIEF DESCRIPTION OF THE DRAWINGS

The present application will hereinafter be described in conjunction with the following drawing figures, wherein like numerals denote like elements, and:

FIG. 6 depicts one embodiment of an annunciation from an annunication system that takes the form of a displayed table; and FIG. 7 depicts another embodiment of a n annunciation from an annunciation system that takes the form of a displayed table.

DETAILED DESCRIPTION

The following detailed description is merely illustrative in nature and is not intended to limit the embodiments of the subject matter or the application and uses of such embodiments. As used herein, the word "exemplary" means "serving as an example, instance, or illustration." Thus, any embodiment described herein as "exemplary" is not necessarily to be construed as preferred or advantageous over other embodiments. The embodiments described herein are exemplary embodiments provided to enable persons skilled in the art to make or use the invention and not to limit the scope of the invention that is defined by the claims. Furthermore, there is no intention to be bound by any expressed or implied theory presented in the preceding technical field, background, summary, or the following detailed description.

Exemplary embodiments of the novel disclosed system for evaluation of loss of separation (FIG. 1, 102) provide technologically improved systems and methods for determining when a potential loss of separation (LOS) may occur, specifically when the LOS is based on a flight profile change that originated in a CPDLC message, or guidance from an autopilot system. The figures and descriptions below provide more detail.

Figure 1:
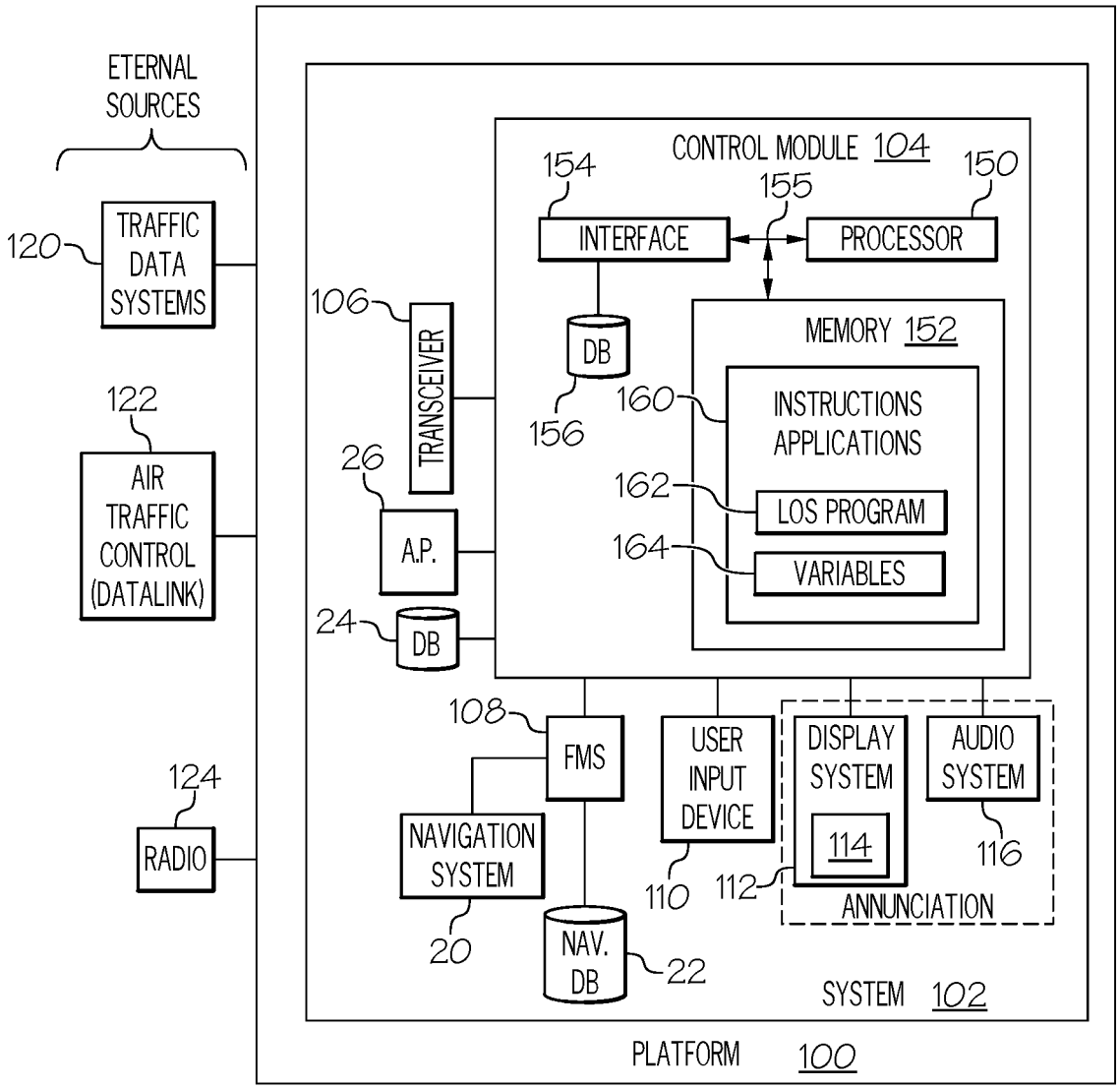
FIG. 1 is a block diagram of a system for evaluation of loss of separation, in accordance with an exemplary embodiment.

Turning now to FIG. 1, in an embodiment, the system for evaluation of loss of separation 102 (also referred to herein as "system" 102) is generally located in a mobile platform 100. In various embodiments, the mobile platform 100 is an aircraft, and is referred to as aircraft 100. The system 102 embodies a traffic management control module 104 (also referred to herein as "control module" 104). Although the control module 104 is shown as an independent functional block, it may exist separate from, or integrated within, a preexisting mobile platform management system, avionics system, cockpit display system (CDS), flight controls system (FCS), or aircraft flight management system (FMS). In other embodiments, the control module 104 may exist within an optional electronic flight bag (EFB). In embodiments in which the control module 104 is within the EFB, the display system 112 and user input device 110 may also be part of the EFB.

The control module 104 performs the functions of the system 102. In order to perform these functions, the control module 104 may be operatively coupled to any combination of the following aircraft systems: a transceiver 106, a source of aircraft status data, such as a flight management system (FMS) 108, a user input device 110, and one or more annunciation systems, such as display system 112 and/or audio system 116. The functions of these aircraft systems, and their interaction, are described in more detail below.

The FMS 108 is configured to provide real-time navigational data and/or information regarding operation of the aircraft 100, including real-time flight guidance for aircraft 100. As used herein, "real-time" is interchangeable with current and instantaneous. In operation, the FMS 108 may further be integrated with, or receive and process, real-time data and information from a navigation system 20 and a navigation database 22. As used herein, the FMS 108 supports bidirectional pilot-to-ATC (air traffic control) communications via a datalink, generally referred to as controller pilot data link communications (CPDLC), such as through a reporting system (ACARS) router; this feature may be referred to as a communications management unit (CMU) or communications management function (CMF). An instance of pilot-to-ATC communications is often referred to as a controller pilot datalink communications (CPDLC) message, and the CPDLC messages of relevance herein contain a flight profile change (lateral and/or vertical) for the host aircraft; further, a CPDLC message is referred to as a request when it is sourced by a pilot, and as a conditional clearance when it is sourced from ATC.

The navigation system 20 may be realized as including a global positioning system (GPS), inertial reference system (IRS), or a radio-based navigation system (e.g., VHF omnidirectional radio range (VOR) or long-range aid to navigation (LORAN)), and may include one or more navigational radios or other sensors suitably configured to support operation of the FMS 108, as will be appreciated in the art. The navigation database 22 may be a storage location that may maintain a database of flight plans, as well as information regarding terrain and airports and/or other potential landing locations (or destinations) for the aircraft 100. In this regard, the navigation database 22 can maintain an association between a respective airport, its geographic location, runways (and their respective orientations and/or directions), instrument procedures (e.g., approaches, arrival routes, and the like), airspace restrictions, and/or other information or attributes associated with the respective airport (e.g., widths and/or weight limits of taxi paths, the type of surface of the runways or taxi path, and the like).

Accordingly, the FMS 108 is a source for real-time aircraft status of the aircraft 100, the aircraft status data (also referred to herein as navigation data) including any of: (i) the instantaneous position and location, vertical speed, and ground speed of the aircraft 100 (e.g., the latitude, longitude, orientation, and flight path angle), (ii) the instantaneous altitude (or height above ground level) for the aircraft 100, (iii) the instantaneous heading of the aircraft 100 (i.e., the direction the aircraft is traveling in relative to some reference), and (iv) a current phase of flight. Additionally, the FMS 108 is configured to compare the instantaneous position and heading of the aircraft 100 with an intended flight plan for the aircraft 100. Host aircraft status data is made available such that the display system 112, the transceiver 106, and the control module 104, may further process and/or handle the aircraft status data.

The display system 112 includes a display device 114. The display system 112 is configured to continuously receive real-time flight status and flight plan information from the FMS 108. The control module 104 and the display system 112 are cooperatively configured to generate the commands ("display commands") for the display device 114 to render thereon the various graphical user interface elements, such as the tables, menus, and buttons, as described herein. In exemplary embodiments, the display device 114 is realized on one or more electronic display devices configured as a combination of a vertical situation display (VSD) and a lateral navigation display (ND). The VSD renders a graphical representation of the aircraft 100 and one or more of the airspace, air traffic, navigational reference points, and a vertical flight plan associated with a flight plan of the aircraft 100. The ND renders a top down graphical representation of the aircraft 100 and one or more of the terrain, meteorological conditions, airspace, air traffic, navigational reference points, and a route associated with a lateral flight plan of the aircraft 100. Each of the VSD and ND are responsive to display commands from the control module 104 and/or display sy stem 112.

Renderings on the display system 112 may be processed by a graphics system, components of which may be integrated into the display system 112 and/or be integrated within the control module 104. Display methods include various types of computer generated symbols, text, and graphic information representing, for example, pitch, heading, flight path, airspeed, altitude, runway information, waypoints, targets, obstacles, terrain, and required navigation performance (RNP) data in an integrated, multi-color or monochrome form. Display methods also include various techniques for visually distinguishing objects. The control module 104 is said to display various images and selectable options described herein. In practice, this may mean that the control module 104 generates display commands, and responsive to receiving the display commands from the control module 104, the display system 112 displays, renders, or otherwise visually conveys on the display device 114, graphical representations or images associated with operation of the aircraft 100, and specifically, one or more pictorial images as described herein.

The user input device 110 and the control module 104 are cooperatively configured to allow a user (e.g., a pilot, co-pilot, or crew member) to interact with the display devices 114 in the display system 112 and/or other elements of the system 102, as described in greater detail below. Depending on the embodiment, the user input device 110 may be realized as a keypad, touchpad, keyboard, mouse, touch panel (or touchscreen), joystick, knob, line select key or another suitable device adapted to receive input from a user. When the user input device 110 is configured as a touchpad or touchscreen, it may be integrated with the display system 112. As used herein, the user input device 110 may be used to provide a pilot requested flight profile change in the form of a CPDLC request.

In various embodiments, any combination of the FMS 108, user input device 110, and transceiver 106, may be coupled to the display system 112 such that the display system 112 may generate or render, on a display device, real-time information associated with respective aircraft 100 components. Coupled in this manner, the FMS 108 and transceiver 106 are configured to support navigation, flight planning, and other aircraft control functions in a conventional manner, as well as to provide real-time data and/or information regarding the operational status of the aircraft 100 to the control module 104. Additionally, in some embodiments, the user input device 110, FMS 108, and display system 112 are configured as a control display unit (CDU).

External sources communicate with the aircraft 100, generally by way of transceiver 106. External sources include traffic data system(s) 120, air traffic control (ATC) 122, and a variety of other radio inputs 124. The traffic data system(s) 120 include numerous systems for providing real-time neighbor traffic data and information. For example, traffic data systems 120 may include any combination of: traffic collision avoidance system (TCAS), automatic dependent surveillance broadcast (ADS-B), traffic information system (TIS), crowd sourced traffic data and/or another suitable avionics system. Flight traffic information that is received from the traffic data system may include, for each neighbor aircraft of a plurality of neighbor aircraft, one or more of a respective (i) instantaneous position and location, vertical speed, and ground speed, (ii) instantaneous altitude, and (iii) instantaneous heading of the aircraft.

The transceiver 106 is configured to support instantaneous (i.e., real time or current) communications between the aircraft 100 and the one or more external data source(s). As a functional block, the transceiver 106 represents one or more transmitters, receivers, and the supporting communications hardware and software required for the system 102 to communicate with the various external data source(s) as described herein. In an example, the transceiver 106 is configured to include or support an automatic dependent surveillance broadcast system (ADS-B), a communication management function (CMF) uplink, a terminal wireless local area network (LAN) unit (TWLU), or any other suitable radio communication system that supports communications between the aircraft 100 and the various external source(s). In this regard, the transceiver 106 may allow the aircraft 100 to receive information that would otherwise be unavailable to the pilot and/or co-pilot using only the onboard systems.

In various embodiments, the control module 104 is additionally operationally coupled to an automatic pilot system (AP) 26 and a database 24. The AP 26 may coordinate aircraft systems, such as an engine thrust system and the navigation system 20, to control aircraft 100 flight along an intended flight path. The database 24 may be utilized to maintain the aforementioned loss of separation rules (LOS rules) for reference during operation of the system 102. Additionally, in some embodiments, the database 24 may include airport status data for the runways and/or taxi paths at the airport indicating operational status and directional information for the taxi paths (or portions thereof).

When used for alerting, the display system 112 may be considered an annunciation system. The control module 104 and the display system 112 are cooperatively configured to cause the display device 114 to render thereon visual alerts regarding potential LOS events. In an example, a pictorial image is rendered that visually distinguishes: the host aircraft; the modified host flight path; the associated neighbor aircraft; a trajectory of a neighbor aircraft; and the location of the potential LOS. Display commands from the control module 104 that specifically direct the herein described tabular and pictorial displays are called annunciation commands. The audio system 116 may also be used for annunciation. It may be appreciated that the audio system 116 generally includes one or more audio devices for emitting sound and/or speech. In various embodiments, in response to receiving annunciation commands, the audio system 116 may emit sounds or speech suitable to alert a pilot or crew of a potential LOS. Audio commands from the control module 104 that specifically direct the herein described sounds and speech for LOS alerts are also annunciation commands.

As mentioned, the control module 104 performs the functions of the system 102. As used herein, the term "module" refers to any means for facilitating communications and/or interaction between the elements of the system 102 and performing additional processes, tasks and/or functions to support operation of the system 102, as described herein. In various embodiments, the control module 104 may be any hardware, software, firmware, electronic control component, processing logic, and/or processor device, individually or in any combination. Depending on the embodiment, the control module 104 may be implemented or realized with a general purpose processor (shared, dedicated, or group) controller, microprocessor, or microcontroller, and memory that executes one or more software or firmware programs; a content addressable memory; a digital signal processor; an application specific integrated circuit (ASIC), a field programmable gate array (FPGA); any suitable programmable logic device; combinational logic circuit including discrete gates or transistor logic; discrete hardware components and memory devices; and/or any combination thereof, designed to perform the functions described herein.

As depicted in FIG. 1, in an embodiment, the control module 104, includes a processor 150 and a memory 152. The processor 150 may comprise any type of processor or multiple processors, single integrated circuits such as a microprocessor, or any suitable number of integrated circuit devices and/or circuit boards working in cooperation to carry out the described operations, tasks, and functions by manipulating electrical signals representing data bits at memory locations in the system memory, as well as other processing of signals. The memory 152 maintains data bits and may be utilized by the processor 150 as storage and/or a scratch pad. The memory 152 may be located on and/or co-located on the same computer chip as the processor 150. In the depicted embodiment, the memory 152 stores instructions and applications 160 and one or more configurable variables in stored variables 164. Information in the memory 152 may be organized and/or imported from an external data source during an initialization step of a process; it may also be programmed via a user input device 110.

A novel program 162 is embodied in the memory 152 (e.g., RAM memory, ROM memory, flash memory, registers, a hard disk, or the like) or another suitable non-transitory short or long-term storage media capable of storing computer-executable programming instructions or other data for execution. The program 162 includes rules and instructions which, when executed, cause the system 102 to perform the functions, techniques, and processing tasks associated with the operation of the system 102 described herein.

Based in part on being programmed with program 162, the processor 150 and the memory 152 form a novel LOS evaluation processing engine that performs the processing activities of the system 102. During operation, the processor 150 loads and executes one or more programs, algorithms and rules embodied as instructions and applications 160 contained within the memory 152 and, as such, controls the general operation of the control module 104 as well as the system 102. In executing the process described herein, the processor 150 specifically loads and executes the instructions embodied in the program 162. Additionally, the processor 150 is configured to, in accordance with the program 162: receive a CPDLC message, and process the CPDLC message with loss of separation rules, received host aircraft status data, and received traffic flight information, to (a) construct a modified host flight path based on incorporating the host profile change without delay, (b) identify a potential loss of separation (LOS) event between the modified host flight path and a neighbor aircraft trajectory, and (c) responsive to identifying the potential LOS event, generate annunciation commands for an annunciation system.

In various embodiments, the processor/memory unit of the control module 104 may be communicatively coupled (via a bus 155) to an input/output (I/O) interface 154, and a database 156. The bus 155 serves to transmit programs, data, status and other information or signals between the various components of the control module 104. The bus 155 can be any suitable physical or logical means of connecting computer systems and components. This includes, but is not limited to, direct hard-wired connections, fiber optics, infrared and wireless bus technologies.

The I/O interface 154 enables intra control module 104 communication, as well as communications between the control module 104 and other system 102 components, and between the control module 104 and the external data sources via the transceiver 106. The I/O interface 154 may include one or more network interfaces and can be implemented using any suitable method and apparatus. In various embodiments, the I/O interface 154 is configured to support communication from an external system driver and/or another computer system. Also, in various embodiments, the I/O interface 154 may support communication with technicians, and/or one or more storage interfaces for direct connection to storage apparatuses, such as the database 156. In one embodiment, the I/O interface 154 is integrated with the transceiver 106, and obtains data from external data source(s) directly.

The database 156 may include an aircraft-specific parameters database (comprising aircraft-specific parameters for aircraft 100, as well as for a variety of other aircrafts) and parameters and instructions for processing user inputs and rendering images on the display device 114, as described herein. In some embodiments, the database 156 is part of the memory 152. In various embodiments, the database 156 and the database 24 are integrated, either within the control module 104 or external to it. Accordingly, in some embodiments, the LOS rules are pre-loaded and internal to the control module 104.

The images displayed on the display device 114 are understood to be based on current host aircraft status data for the aircraft 100 and to be dynamically updated based on continuously obtaining the current aircraft status data. As used herein, a "viewing segment" is at least a portion of a current path that the aircraft 100 is traveling on; in various embodiments, the display device 114 depicts the same viewing segment on each of the VSD and ND. The images on display device 114 may also be continuously updated to reflect neighbor traffic within the bounds of the viewing segment.

Figure 2A:
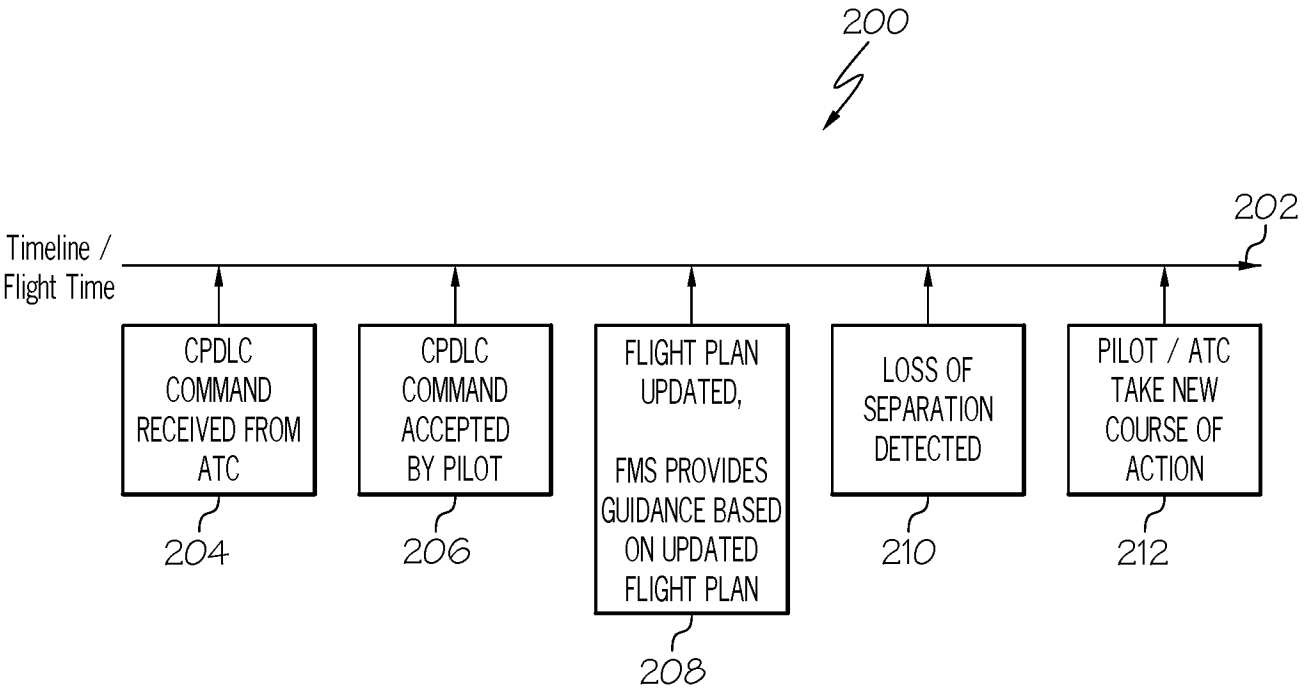
FIG. 2A and FIG. 2B are illustrations showing how the temporal order of events may change as a result of utilizing the system for evaluation of loss of separation, in accordance with an exemplary embodiment.
Figure 2B:
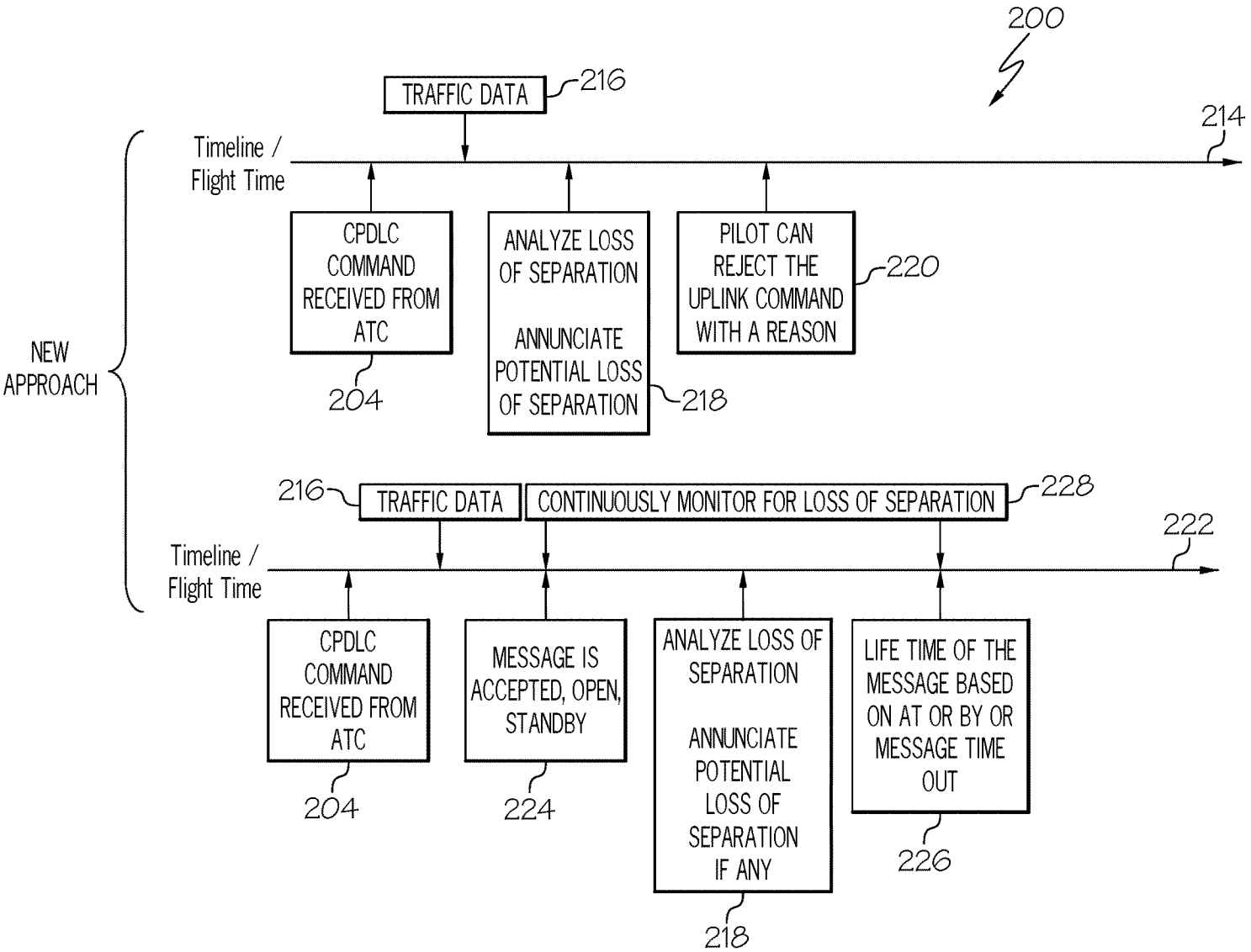
Figure 3:
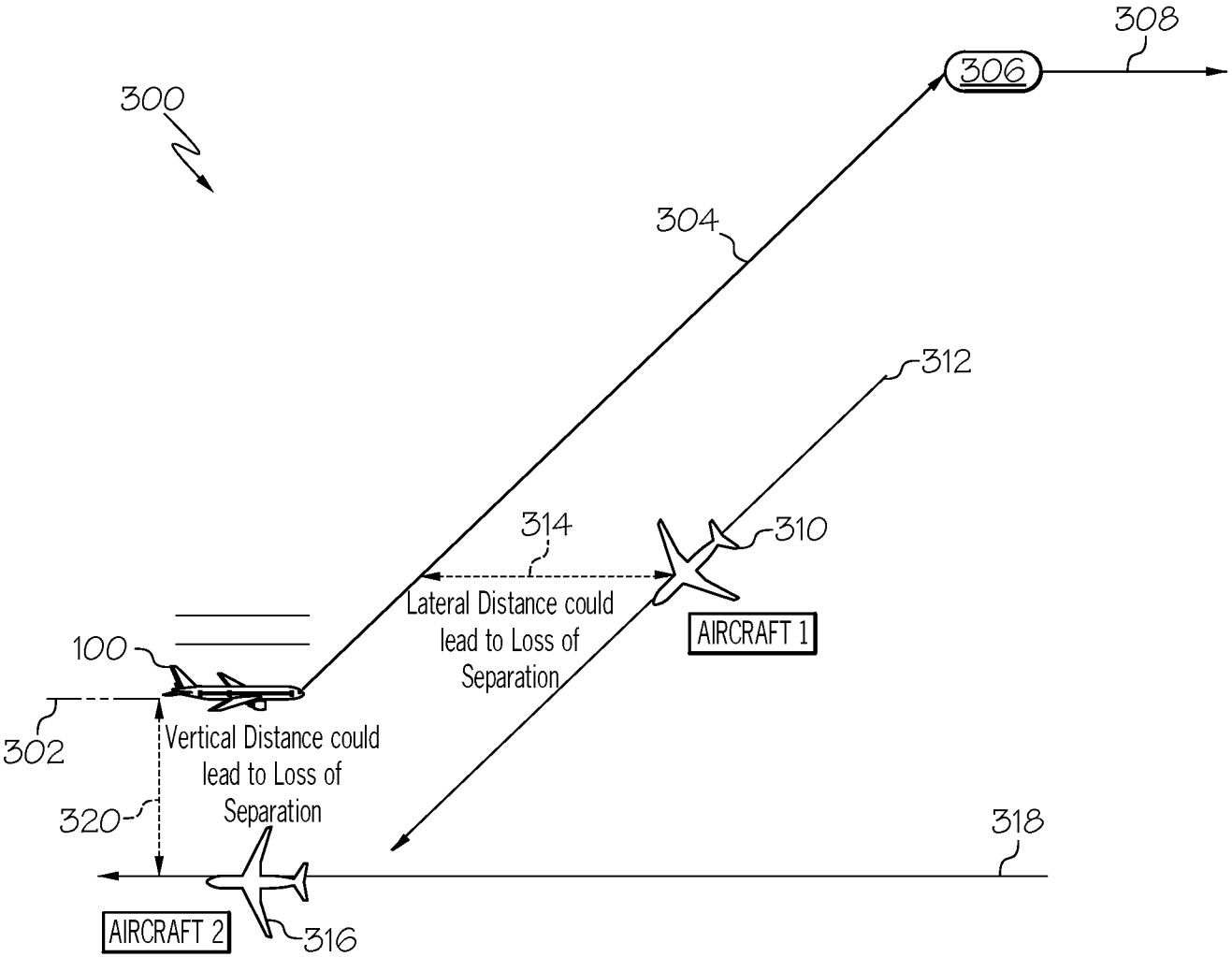
FIGS. 3-4 are illustrations showing various potential loss of separation events that may be detected by the system for evaluation of loss of separation, in accordance with an exemplary embodiment.

Turning now to FIGS. 2A, 2B, and 3, some relevant measurements and features are depicted and described. In illustration 200, timelines extend from left to right, with events on the left occurring before events on the right, as is customary. Regarding the timeline 202: The host aircraft 100 is flying on a current flight path (FIG. 3, 302) in accordance with a flight plan. At 204, (time T for reference) a CPDLC message with a flight profile change for the host aircraft is received from ATC, and at 206 the CPDLC message is accepted by the pilot. Responsive to accepting the CPDLC message, a modified host flight path is constructed based on incorporating the flight profile change without delay (i.e., at time T, the aircraft begins the profile change), the host flight plan is updated, and the FMS 108 begins providing guidance based on the modified flight path. At 210, a loss of separation is detected, and responsive to the loss of separation at 210, the pilot and ATC take a new course of action. The timeline 202 shows a sequence of events that may occur without utilizing the novel system for evaluating loss of separation 102.

As mentioned, a technological effect of the present disclosure is the earlier warnings of potential LOS, particularly as related to profile changes embedded in a CPDLC command. This expands the amount of decision time for a pilot to react to a potential LOS, which then expands the options for response to the potential LOS. Accordingly, timelines 214 and 222 show exemplary sequences of events using the novel system for evaluating loss of separation.

Regarding the timeline 214: The host aircraft 100 is flying on an intended flight path in accordance with a flight plan. At 204, (time T for reference) a CPDLC message with a flight profile change for the host aircraft is received from ATC, and at 216 traffic flight information for a plurality of neighbor traffic is received. At 218, the system 102 evaluates potential loss of separation, in accordance with a method, such as method 500 of FIG. 5, and annunciates a potential LOS. Specifically, at 218, the control module 104 processes the CPDLC message with loss of separation rules, the host aircraft status data, and the traffic flight information, to construct a modified host flight path based on incorporating the host profile change without delay (i.e., substantially at time T, the aircraft begins the profile change).

Constructing a modified host flight path implies that the CPDLC message is parsed to isolate the flight profile change, which is with respect to a current flight path 302 that the host aircraft 100 is flying. The control module 104 then identifies a potential loss of separation (LOS) event between the modified host flight path and a neighbor aircraft trajectory. Identifying a potential LOS event implies that the control module 104 has first constructed, for a neighbor aircraft, a trajectory of the neighbor aircraft (called neighbor aircraft trajectory herein), using the received traffic flight information. Responsive to identifying the potential LOS event, the control module 104 promptly generates annunciation commands for the annunciation system. The pilot may then view and/or hear the annunciation and respond accordingly. At 220 the pilot, having advance notice of the potential LOS associated with the profile change in the CPDLC, may reject the CPDLC message with a reason, such as the predicted LOS provided by the system 102.

Regarding the timeline 222: The host aircraft 100 is flying on a current flight path 302 in accordance with a flight plan. At 204, (time T for reference) a CPDLC message with a flight profile change for the host aircraft is received from ATC, and at 216 traffic flight information for a plurality of neighbor traffic is received. At 224, the CPDLC message is either accepted, open, standby state. Accordingly, if the CPDLC is ultimately acted on, it will result in constructing a modified host flight path based on incorporating the host profile change with a delay (delay time t, for reference). At 218, the system 102 evaluates potential loss of separation, in accordance with a method, such as method 500 of FIG. 5, and annunciates a potential LOS. From the time the CPDLC message is accepted at 224 until the expiration of the lifetime of the CPDLC message at 226, (i) the aircraft 100 continues on its intended flight path in accordance with its flight plan, and (ii) system 102 continuously evaluates potential loss of separation, in accordance with a method, such as method 500 of FIG. 5, and annunciates any potential LOS identified (228).

Image 300 (FIG. 3) depicts the host aircraft 100 on its current flight path 302. A CPDLC message with a profile change (to altitude 306) is received. Path 304 and path 308 represent the modified host flight path based on incorporating the host profile change without delay (i.e., substantially at time T). In image 300, a first neighbor aircraft 310 is on aircraft trajectory 312 and a second neighbor aircraft 316 is on aircraft trajectory 318. The control module 104 processes this information to identify a first potential LOS with the first neighbor aircraft, the first LOS being a lateral distance 314 separation LOS. The control module 104 also identifies a second LOS with the second neighbor aircraft, the second LOS being a vertical separation 320 LOS. Note that neither of these neighbor aircraft trajectories intersect with the modified host flight path, therefore, the LOS events do not have a point of convergence (POC), point of divergence (POD), or associated angle. Responsive to identifying these two LOS events, the control module 104 generates commands for an annunciation system. In an embodiment, the annunciation system is the display system 112, and the subsequent annunciation takes the form of a displayed table, such as TABLE 1, below. In TABLE 1, which is depcited in FIG. 6. each entry includes neighbor aircraft information for the LOS event, accordingly, as it applies to the neighbor aircraft: a POI type, a vertical distance, a lateral distance, a time away from the host aircraft based on velocity and direction, and an angle between the modified host aircraft path and the neighbor aircraft trajectory. As part of annunciation, techniques may be used to visually distinguish the table entries that most need attention.

Figure 4:
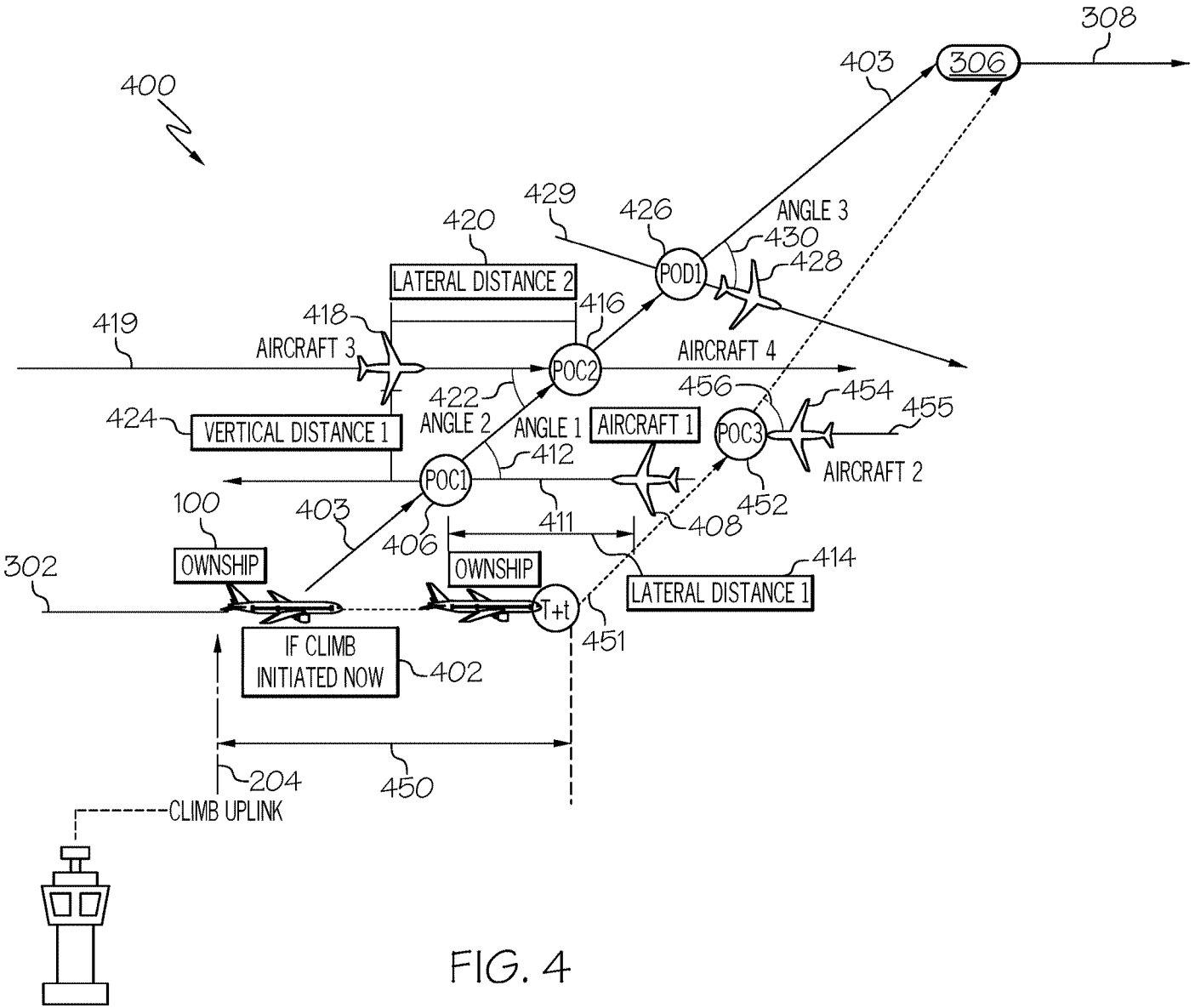

As alluded to above, in some scenarios, a neighbor aircraft trajectory intersects the modified host flight path, therefore, the LOS events have an included point of intersection (POI). The control module 104 then determines, for a POI, a POI type from the set including: none, a point of convergence (POC) and a point of divergence (POD), and associates an angle with the POC or POD, as well as any attendant vertical or lateral distance. Turning now to FIG. 4, and with continued reference to FIGS. 1-3, these scenarios are described.

As in the previous images, initially, host aircraft 100 is flying current flight path 302. The control module 104 is continuously receiving the traffic flight information, and continuously receiving host aircraft status data. At time T, a CPDLC message with a profile change (to altitude 306) is received. A modified host flight path 403 to altitude 306 and path 308 thereafter is constructed, based on incorporating the host profile change without delay (i.e., substantially at time T). Based on the climb initiated at time T 402, the control module 104 identifies:

- a LOS event 406 with neighbor aircraft 1 (408) on neighbor aircraft trajectory 411. LOS event 406 is a POI that is of type POC. LOS event 406 is a lateral distance 414, having angle 412.
- a LOS event 416 with neighbor aircraft 3 (418) on neighbor aircraft trajectory 419. LOS event 416 is a POI that is of type POC. LOS event 416 is a lateral distance 420, having angle 422.
- a LOS event 426 with neighbor aircraft 4 (428) on neighbor aircraft trajectory 429. LOS event 426 is a POI that is of type POD. LOS event 426 has angle 430 of divergence.

The control module 104 also constructs a second modified host flight path 451 to altitude 306 and path 308, based on incorporating the host profile change with a delay of time t 450 (i.e., substantially at time T+t). Based on the second modified host flight path 451 at time T+t, the control module 104 identifies:

- a LOS event 452 with neighbor aircraft 2 (454) on neighbor aircraft trajectory 455. LOS event 406 is a POI that is of type POC. LOS event 452 is a lateral distance of half a nautical mile (NM), having angle 456.

As before, the control module 104 generates annunciation commands for the annunciation system, and components of the annunciation system respond to the annunciation commands by annunciating each potential LOS and its location. In an embodiment, the annunciation system is the display system 112, and the subsequent annunciation takes the form of a displayed table, such as TABLE 2, below. In TABLE 2, which is depicted in FIG. 7, each entry includes neighbor aircraft information for the LOS event, accordingly, as it applies to the neighbor aircraft: POI type, a vertical distance, a lateral distance, and an angle. In some embodiments, the received traffic flight information includes an aircraft ID, and the aircraft ID for each relevant neighbor aircraft is also annunciated, by being displayed in the table and/or on a pictorial image displayed on the display device 114, and/or aurally via the audio system 116. Techniques may be used to visually distinguish the table entries that most need attention from determinations made about neighboring aircraft that are a lesser threat, or those that do not impose a LOS threat at all. In TABLE 2, a color may be used to indicate that flight BA 150 is a moderate level lateral LOS event at 1 nautical mile (NM), and a separate color may be used to indicate that the following are critical level LOS events: flight AA 205 is a lateral LOS and a vertical LOS event at 0.5 NM and 100 feet, respectively, and flight SA 1344 is a vertical LOS at 50 feet.

In some embodiments, the LOS events are rendered on the display as a pictorial image. Techniques such as changing colors and line thickness may be used to distinguish a path from another path such that the resulting pictorial image visually distinguishes: the host aircraft; the modified host flight path; the neighbor aircraft; the associated neighbor aircraft trajectory; and the location of the potential LOS. In some embodiments, both the pictorial images and the tables are used to annunciate the LOS. In some embodiments, the audio system is also used to emit speech and sounds sufficient to alert a pilot of at least: the potential LOS and the location of the potential LOS.

Figure 5:
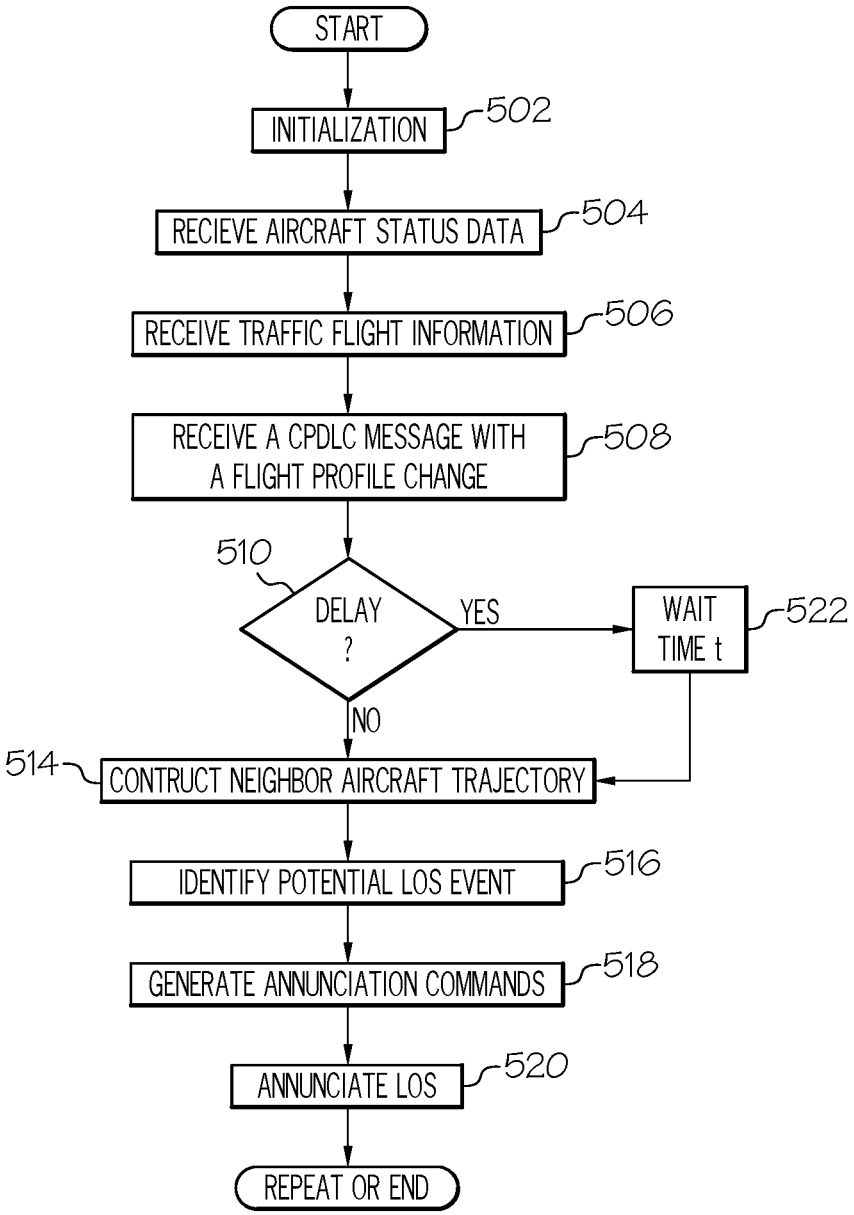
FIG. 5 is a flow chart for a method for evaluation of loss of separation, in accordance with an exemplary embodiment.

As mentioned, the processor 150 and the program 162 form a LOS evaluation engine that continually, and in real time, processes various data received and, responsive to a CPDLC message, identifies and annunciates potential LOS events, in accordance with a set of rules encoded in the program 162. Referring now to FIG. 5 and with continued reference to FIGS. 1-4, a flow chart is provided for a method 500 for providing a system 102, in accordance with various exemplary embodiments. Method 500 represents various embodiments of a method for evaluation of LOS. For illustrative purposes, the following description of method 500 may refer to elements mentioned above in connection with FIG. 1. In practice, portions of method 500 may be performed by different components of the described system. It should be appreciated that method 500 may include any number of additional or alternative tasks, the tasks shown in FIG. 5 need not be performed in the illustrated order, and method 500 may be incorporated into a more comprehensive procedure or method having additional functionality not described in detail herein. Moreover, one or more of the tasks shown in FIG. 5 could be omitted from an embodiment of the method 500 if the intended overall functionality remains intact.

The method starts, and at 502 the control module 104 is initialized. As mentioned above, initialization may comprise uploading or updating instructions and applications 160, program 162, stored variables 164, and the various lookup tables stored in the database 156. Predetermined variables may include, for example, predetermined distances and times to use as thresholds, parameters for setting up a user interface, and the various shapes, various colors and/or visually distinguishing techniques used for tables, icons, and alerts. In some embodiments, program 162 includes additional instructions and rules for rendering information differently based on type of display device in display system 112. Initialization at 502 may also include identifying external sources and/or external signals and the communication protocols to use with each of them.

At 504 aircraft status data is received from a source of aircraft status data, such as a FMS 108; this is continuous during operation. At 504, the display system 112 may also be continuously rendering and updating the viewing segment surrounding the host aircraft. At 506, traffic flight information is received for one or more neighbor aircraft throughout flight operation. A threshold of distance or time may be used to determine which of the neighbor traffic are relevant to render on the viewing segment. The traffic flight information is continuously received during operation. At 508, a CPDLC message having a flight profile change is received. The CPDLC message may be sent from ATC, via datalink, and may therefore be a CPDLC conditional clearance. The CPDLC message may also be a request for a profile change that a pilot has entered. At 510, if a delay is not utilized, a modified host flight path 403 based on incorporating the host profile change without a delay (i.e., at time T (FIG. 4, 402) is constructed. At 510, if a delay oft is utilized, a second modified host flight path 451 based on incorporating the host profile change with a delay t is constructed (i.e., at time T+t, FIG. 4, 450).

At 514, one or more neighbor aircraft trajectories are constructed for neighbor traffic in the vicinity of the modified host flight path. At 516, the LOS evaluation engine in the system 102 identifies one or more potential LOS events using the modified host flight path and the neighbor aircraft trajectories. When a LOS is identified, it is further determined whether it is a lateral LOS or a vertical LOS, and the associated distance and angle is determined. Also, for each identified LOS, it is determined, based on the LOS rules, whether it is a moderate or critical LOS. Additionally, when a LOS is identified, it is also evaluated for whether there is a point of intersection, and if so, a point of intersection (POI) type. The POI is then labeled from among the set including: none, a point of convergence (POC), and a point of divergence (POD). For each POI, the system 102 determines an associated angle.

At 518, responsive to identifying the potential LOS event, the system 102 generates annunciation commands for an annunciation system. And, at 520, the system 102 annunciates the potential LOS and its location, responsive to the annunciation commands. At 520, the potential LOS may be further annunciated as described above, i.e., in tabular format on a display device 114, as a pictorial image on the display device 114, and/or as audible sounds and speech via the audio system 116. After 520, the method may repeat or end.

As is readily appreciated, the above examples of the system for evaluation of loss of separation 102 are non-limiting, and many others may be addressed by the control module 104. Thus, systems and methods directed to providing advance notice of a potential LOS event responsive to a CPDLC command are provided.

Those of skill in the art will appreciate that the various illustrative logical blocks, modules, circuits, and algorithm steps described in connection with the embodiments disclosed herein may be implemented as electronic hardware, computer software, or combinations of both. Some of the embodiments and implementations are described above in terms of functional and/or logical block components (or modules) and various processing steps. However, it should be appreciated that such block components (or modules) may be realized by any number of hardware, software, and/or firmware components configured to perform the specified functions. To clearly illustrate the interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention. For example, an embodiment of a system or a component may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments described herein are merely exemplary implementations.

Further, the various illustrative logical blocks, modules, and circuits described in connection with the embodiments disclosed herein may be implemented or performed with a general-purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of the method or algorithm described in connection with the embodiments disclosed herein may be embodied directly in hardware, in a software module executed by a controller or processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. When "or" is used herein, it is the logical or mathematical or, also called the "inclusive or." Accordingly, A or B is true for the three cases: A is true, B is true, and, A and B are true. In some cases, the exclusive "or" is constructed with "and;" for example, "one from the set including A and B" is true for the two cases: A is true, and B is true.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

It will also be appreciated that while the depicted exemplary embodiment is described in the context of a fully functioning computer system, those skilled in the art will recognize that the mechanisms of the present disclosure are capable of being distributed as a program product with one or more types of non-transitory computer-readable signal bearing media used to store the program and the instructions thereof and carry out the distribution thereof, such as a non-transitory computer readable medium bearing the program 162 and containing computer instructions stored therein for causing a computer processor (such as the processor 150) to perform and execute the program 162. Such a program product may take a variety of forms, and the present disclosure applies equally regardless of the particular type of computer-readable signal bearing media used to carry out the distribution. Examples of signal bearing media include: recordable media such as floppy disks, hard drives, memory cards and optical disks, and transmission media such as digital and analog communication links. It will be appreciated that cloud-based storage and/or other techniques may also be utilized in certain embodiments.

What is claimed is:

1. A method for evaluating loss of separation, the method comprising:

continuously receiving, from a source of host aircraft status data, a host speed, host position and location, and a host flight path angle;

continuously receiving, from a traffic data system, traffic flight information for a plurality of neighbor traffic;

receiving, from a controller pilot data link communication (CPDLC) source, a CPDLC message including a host flight profile change; and, responsive to receiving the CPDLC message, processing, at a control module, the CPDLC message with loss of separation rules, the host aircraft status data, and the traffic flight information, to (a) construct a modified host flight path based on incorporating the host profile change without delay, (b) identify a potential loss of separation (LOS) event between the modified host flight path and a neighbor aircraft trajectory, and (c) responsive to identifying the potential LOS event, generating annunciation commands for an annunciation system; and annunciating, by the annunciation system, the potential LOS and its location, responsive to the annunciation commands.

2. The method of claim 1, wherein the CPDLC message is from one of (i) an air traffic control (ATC) conditional clearance, and (ii) a pilot request.

3. The method of claim 2, wherein, the traffic data system is one of (i) a traffic collision avoidance system (TCAS), (ii) an automatic dependent surveillance broadcast (ADS-B) system, (iii) a traffic information system (TIS), and (iv) a system of crowd sourced traffic data.

4. The method of claim 3, wherein the neighbor aircraft trajectory is a first neighbor aircraft trajectory associated with a first neighbor aircraft, and further comprising, responsive to receiving the CPDLC message, (d) constructing a second modified host flight path based on incorporating the host profile change after a time delay (t), (e) processing the traffic flight information to identify a second potential loss of separation (LOS) event between the second modified host flight path and a second neighbor aircraft trajectory associated with a second neighbor aircraft, and (c) responsive to identifying the second potential LOS event, generating annunciation commands for the annunciation device.

5. The method of claim 3, wherein the annunciation system comprises a display system, and annunciating the potential LOS includes rendering a pictorial image thereon that visually distinguishes: the host aircraft; the modified host flight path; the associated neighbor aircraft; the associated neighbor aircraft trajectory; and a location of the potential LOS.

6. The method of claim 5, wherein the source of host aircraft status data comprises a flight management system (FMS).

7. The method of claim 6, further comprising:

determining that the potential LOS includes a point of intersection (POI) between the modified host flight path and the associated neighbor aircraft trajectory; and responsive to determining that the potential LOS includes a POI, identifying (i) a lateral distance from the associated neighbor aircraft to the POI, (ii) a vertical distance from the associated neighbor aircraft to the POI, and (iii) an angle associated with the POI.

8. The method of claim 7, further comprising determining, for the POI, a type from the set including: none, a point of convergence (POC) and a point of divergence (POD).

9. The method of claim 8, wherein the annunciation system further comprises an audio system, and annunciating the potential LOS includes emitting speech and sounds sufficient to alert a pilot of: the potential LOS and the location of the potential LOS.

10. A system for evaluation loss of separation, the system comprising:

a source of host aircraft status data providing a host speed, host position and location, and a host flight path angle;

a traffic data system providing traffic flight information for a plurality of neighbor traffic;

a controller pilot data link communication (CPDLC) source providing a CPDLC message including a host flight profile change;

a traffic management control module configured to:

receive the host aircraft status data, the traffic flight information, and the CPDLC message;

reference loss of separation rules; and construct a modified host flight path based on incorporating the host profile change without delay;

identify a potential loss of separation (LOS) event between the modified host flight path and a neighbor aircraft trajectory, and (c) responsive to identifying the potential LOS event, generate annunciation commands.

11. The system of claim 10, further comprising an annunciation system configured to receive the annunciation commands and annunciate the potential LOS and its location, responsive to the annunciation commands.

12. The system of claim 11, wherein the annunciation system comprises a display system, and annunciating the potential LOS includes rendering a pictorial image thereon that visually distinguishes: the host aircraft; the modified host flight path; the associated neighbor aircraft; the associated neighbor aircraft trajectory; and a location of the potential LOS.

13. The system of claim 12, wherein the source of host aircraft status data comprises a flight management system (FMS).

14. The system of claim 13, wherein the traffic management control module is further configured to:

determine that the potential LOS includes a point of intersection (POI) between the modified host flight path and the associated neighbor aircraft trajectory; and responsive to determining that the potential LOS includes a POI, identify (i) a lateral distance from the associated neighbor aircraft to the POI, (ii) a vertical distance from the associated neighbor aircraft to the POI, and (iii) an angle associated with the POI.

15. The system of claim 14, wherein the traffic management control module is further configured to determine, for the POI, a type from the set including: none, a point of convergence (POC) and a point of divergence (POD).

16. The system of claim 15, wherein the annunciation system comprises an audio system, and the audio system is configured to annunciate the potential LOS includes emitting speech and sounds indicative of: the potential LOS and the location of the potential LOS.

17. A method, comprising:

at a control module, continuously receiving, from a source of host aircraft status data, a host speed, host position and location, and a host flight path angle;

continuously receiving, from a traffic data system, traffic flight information for a plurality of neighbor traffic;

receiving, from a controller pilot data link communication (CPDLC) source, a CPDLC message including a host flight profile change; and, responsive to receiving the CPDLC message, (a) processing the host aircraft status data and the traffic flight information, to (i) construct a modified host flight path based on incorporating the host profile change without delay, and (ii) construct a neighbor aircraft trajectory for a neighbor aircraft; and (b) processing the modified host flight path and the neighbor aircraft trajectory with loss of separation (LOS) rules, to identify a potential loss of separation (LOS) event; and responsive to identifying the potential LOS event, annunciating, by an annunciation system, the potential LOS and its location.

18. The method of claim 17, wherein the annunciation system comprises a display system, and annunciating the potential LOS includes rendering a pictorial image thereon that visually distinguishes: the host aircraft; the modified host flight path; the neighbor aircraft; the neighbor aircraft trajectory; and a location of the potential LOS.

19. The method of claim 18, further comprising:

determining that the potential LOS includes a point of intersection (POI) between the modified host flight path and the neighbor aircraft trajectory; and responsive to determining that the potential LOS includes a POI, identifying (i) a lateral distance from the associated neighbor aircraft to the POI, (ii) a vertical distance from the associated neighbor aircraft to the POI, and (iii) an angle associated with the POI.

20. The method of claim 19, further comprising:

rendering on the display system, a table including for each potential LOS, an aircraft identification, and two or more of: a POI type, a vertical distance, a lateral distance, and an angle.

* * * * *